US006715541B2

(12) United States Patent
Pedersen et al.

(10) Patent No.: US 6,715,541 B2
(45) Date of Patent: Apr. 6, 2004

(54) BALL DROPPING ASSEMBLY

(75) Inventors: Gerald Dean Pedersen, Houston, TX (US); David Eugene Hirth, Pasadena, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 31 days.

(21) Appl. No.: 10/081,062

(22) Filed: Feb. 21, 2002

(65) Prior Publication Data

US 2003/0155115 A1 Aug. 21, 2003

(51) Int. Cl.[7] ..... E21B 33/16
(52) U.S. Cl. ..... 166/75.15; 16/193
(58) Field of Search ..... 166/75.15, 193, 166/177.4, 291

(56) References Cited

U.S. PATENT DOCUMENTS

| | | | | |
|---|---|---|---|---|
| 2,630,179 A | | 3/1953 | Brown | 166/291 |
| 3,086,587 A | * | 4/1963 | Zandmer et al. | |
| 3,444,928 A | | 5/1969 | Pitts | 166/70 |
| 3,971,436 A | | 7/1976 | Lee | 166/70 |
| 4,164,980 A | | 8/1979 | Duke | 166/291 |
| 4,427,065 A | | 1/1984 | Watson | 166/250 |
| 4,491,177 A | | 1/1985 | Baugh | 166/75 R |
| 4,674,573 A | | 6/1987 | Bode | 166/291 |
| 4,782,894 A | | 11/1988 | LaFleur | 166/70 |
| 4,917,184 A | * | 4/1990 | Freeman et al. | 166/285 |
| 5,236,035 A | | 8/1993 | Brisco et al. | 166/70 |

(List continued on next page.)

FOREIGN PATENT DOCUMENTS

EP 0 969 183 A2 1/2000 ..... E21B/33/16

OTHER PUBLICATIONS

USSN 10/616, 643, Filed Jul. 10, 2003, Pedersen, et al., "Plug–Dropping Container For Releasing A Plug Into A Wellbore."
PCT International Search Report, International Application No. PCT/GB03/00307, dated May 21, 2003.
USSN 10/066,460, Filed Jan. 31, 2002, Pederson, et al. "Plug–Dropping Container For Releasing A Plug Into A Wellbore."
Liner Hangers, Bestline Liner Systems, Inc., 2000/2001 General Catalog, Bakersfield, CA, E–mail: bestlinelinersystems.com, 3 Pages.
Cementing Manifold & Wiper Plugs, Applied Technologies, Inc. (ATI), 1 Page.
Liner Hangers, Open Hole Completion Systems, Baker Oil Tools, 6 Pages.

*Primary Examiner*—William Neuder
(74) *Attorney, Agent, or Firm*—Moser, Patterson & Sheridan, L.L.P.

(57) ABSTRACT

A ball dropping assembly for dropping an object such as a spherical ball into a wellbore. The assembly comprises a seat for retaining a ball before it is released, a ball retaining lever, and a shaft for turning the lever. In one embodiment, the assembly is attached to a side bore in fluid communication with a main bore in a cementing head. The ball-retaining lever has at least one finger which is rotated between a ball-retained position and a ball-released position. In the ball-retained position, the first finger is disposed in the entrance from the side bore to the main bore, thereby preventing the ball from entering the main bore of the cementing head. When the ball is ready for release, the lever is rotated in the direction of the main bore, thereby causing the second finger to urge the ball into the bore of the cementing head, and causing the first finger to protrude into the main bore. When a plug is released into the bore from the cementing head, the plug will trip the first finger, causing the ball-retaining lever to rotate back towards the ball-retained position. Thus, the ball dropping assembly also serves as a plug release indicator.

46 Claims, 6 Drawing Sheets

U.S. PATENT DOCUMENTS

| | | | | |
|---|---|---|---|---|
| 5,443,122 | A | 8/1995 | Brisco | 166/285 |
| 5,553,667 | A | 9/1996 | Budde et al. | 166/70 |
| 5,758,726 | A | 6/1998 | Streich et al. | 166/379 |
| 5,833,002 | A | 11/1998 | Holcombe | 166/291 |
| 5,890,537 | A | 4/1999 | Lavaure et al. | 166/285 |
| 5,950,724 | A | 9/1999 | Giebeler | 166/70 |
| 5,960,881 | A | 10/1999 | Allamon et al. | 166/291 |
| 6,182,752 | B1 | 2/2001 | Smith, Jr. et al. | 166/70 |
| 6,206,095 | B1 | 3/2001 | Baugh | 166/70 |
| 6,220,360 | B1 * | 4/2001 | Connell et al. | 166/373 |
| 6,311,711 | B1 | 11/2001 | Skoglund | 137/2 |

* cited by examiner

BALL DROPPING ASSEMBLY

BACKGROUND OF THE INVENTION

1. Field of the Invention

The present invention generally relates to an apparatus for dropping a ball into a wellbore. More particularly, the invention relates to an apparatus for dropping a ball that may also be used as an indicator that a plug has been released into a string of drill pipe.

2. Description of the Related Art

In the drilling of oil and gas wells, a wellbore is formed using a drill bit that is urged downwardly at a lower end of a drill string. After drilling a predetermined depth, the drill string and bit are removed and the wellbore is lined with a string of casing. An annular area is thus formed between the string of casing and the formation. A cementing operation is then conducted in order to fill the annular area with cement. The combination of cement and casing strengthens the wellbore and facilitates the isolation of certain areas of the formation behind the casing for the production of hydrocarbons.

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth such that the upper portion of the second string of casing overlaps the lower portion of the first string of casing. The second liner string is then fixed or "hung" off of the existing casing. Afterwards, the second casing string is also cemented. This process is typically repeated with additional liner strings until the well has been drilled to total depth. In this manner, wells are typically formed with two or more strings of casing of an ever-decreasing diameter.

In the process of forming a wellbore, it is sometimes desirable to utilize various plugs. Plugs typically define an elongated elastomeric body used to separate fluids pumped into a wellbore. Plugs are commonly used, for example, during the cementing operations for a liner.

The process of cementing a liner into a wellbore typically involves the use of liner wiper plugs and drill-pipe darts. A liner wiper plug is typically located inside the top of a liner, and is lowered into the wellbore with the liner at the bottom of a working string. The liner wiper plug has radial wipers to contact and wipe the inside of the liner as the plug travels down the liner. The liner wiper plug has a cylindrical bore through it to allow passage of fluids.

After a sufficient volume of circulating fluid or cement has been placed into the wellbore, a drill pipe dart or pump-down plug, is deployed. Using drilling mud, cement, or other displacement fluid, the dart is pumped into the working string. As the dart travels downhole, it seats against the liner wiper plug, closing off the internal bore through the liner wiper plug. Hydraulic pressure above the dart forces the dart and the wiper plug to dislodge from the bottom of the working string and to be pumped down the liner together. This forces the circulating fluid or cement that is ahead of the wiper plug and dart to travel down the liner and out into the liner annulus.

The cementing operation described above utilizes a cementing head apparatus at the top of the wellbore for injecting cement and other fluids downhole and for releasing the plugs. The cementing head typically includes a dart releasing apparatus, referred to sometimes as a plug-dropping container. Darts used during a cementing operation are held at the surface by the plug-dropping container. The plug-dropping container is incorporated into the cementing head above the wellbore. The typical cementing head also includes some mechanism which allows cement or other fluid to be diverted around the dart until plug-release is desired. Fluid is directed to bypass the dart in some manner within the container until it is ready for release, at which time the fluid is directed to flow behind the plug and force it downhole.

The cementing head often includes a plug release indicator, which informs the operator at the surface that a plug has been released. Generally, the release indicator is located below the plug-dropping container and must be reset after each plug is released. In one arrangement, the plug release indicator has a finger that protrudes into the bore of the cementing head. The finger may be "tripped" by a passing plug in the bore to give a positive indication that a plug has been released. The release indicator has an indicator flag located outside of the cementing head that is visible to an operator to indicate release of a plug downhole through the drill pipe.

Plug release indicators are designed to prevent accidental tripping by fluid flow in the bore. Many release indicators use spring washers to resist fluid forces and to maintain the finger in the bore until the released plug trips the finger. However, the setting of the spring washer must be balanced between resisting fluid flow and indicating plug release. If the setting of the spring is too tight, the force required to trip the indicator may be high enough to impede the downward travel of the plug. If the spring setting is too loose, it may be prematurely tripped.

Another common component of a cementing head or other fluid circulation system is a ball dropping assembly for dropping a ball into the pipe string. The ball may be dropped for many purposes. For instance, the ball may be dropped onto a seat located in the wellbore to close off the wellbore. Sealing off the wellbore allows pressure to build up in the wellbore to actuate a downhole tool such as a packer, a liner hanger, a running tool, or a valve. The ball may also be dropped to shear a pin to operate a downhole tool. Balls are also sometimes used in cementing operations to divert the flow of cement during staged cementing operations. Balls are also used to convert float equipment.

Many ball-dropping assemblies use a retaining device to keep the ball out of the flow stream until release. The retaining device generally includes a plunger that uses linear movement to push the ball into the flow stream at the time of release. These designs tend to extend out from the main body of the cement head, and require numerous manual turns of a wheel to release the ball.

In the assembly of a cementing head, the plug release indicator is typically disposed below the ball dropping assembly in order to verify that a released plug has cleared all possible obstructions in the cementing head. One drawback of this design is that the plug release indicator must be retracted before a ball is released. Additionally, stacking the ball dropping assembly over the plug release indicator increases the length and size of the head member. Furthermore, two different actuators are required to separately actuate a plug release indicator and a ball dropping mechanism.

Therefore, a need exists for a ball dropping assembly that can both drop a ball into the wellbore and indicate that a plug has been released. There is a further need for an apparatus for dropping a ball and for indicating plug release that is more compact, efficient, and inexpensive than using two separate devices for performing these functions. Still further, there is a need for a ball dropping assembly which allows a ball to be dropped into a wellbore without separately retracting a plug release indicator. There is also a need for a combined dart release indicator and ball-dropping apparatus which will reduce the actuator power and control system requirements for remotely controlled operations.

SUMMARY OF THE INVENTION

The present invention provides a ball dropping assembly for use in wellbore operations. The novel assembly provides a means for both dropping a ball and for indicating that a plug has been released from a cementing head or other plug-dropping apparatus into a wellbore. The assembly of the present invention first comprises a seat for retaining a ball before it is released. The apparatus further comprises a lever for retaining the ball in the seat. The ball-retaining lever has a first finger and a second finger that together form a L-shaped lever whereby the ball is maintained between the two fingers. The ball dropping assembly also comprises a shaft for turning the lever. The shaft also serves as a pin about which the lever pivots from a ball-retained position to a ball released position.

The assembly is located in a side bore adjacent to the main bore in the cementing head. In the ball retained position, the first finger is disposed in the entrance from the side bore to the main bore, thereby preventing the ball from entering the main bore of the cementing head and dropping into the wellbore. Relative to the first finger, the second finger is disposed within the side bore and over the ball. When the ball is ready for release, the lever is rotated in the direction of the main bore, thereby causing the first finger to protrude into the main bore, and simultaneously causing the second finger to urge the ball to unseat and to enter the main bore. This rotation also moves the first finger into position to indicate plug release. When a plug is released into the bore, it will travel down the main bore and trip the first finger causing the ball retaining lever to rotate back into the ball retained position. Rotation of the lever causes the shaft to rotate external to the cement head, providing visual confirmation to the operator of plug release downhole.

In another aspect of the present invention, the shaft extends perpendicularly through a housing of the cementing head. Sealingly extending the shaft through both sides of the housing provides a pressure-balanced ball dropping assembly that can be actuated with a small amount of torque. Each end of the shaft has an actuating lever for rotating the shaft. The actuating levers are located outside the cementing head and held in position by a detent in the outer wall of the body of the cementing head. The actuating levers also serve as confirmation means for plug release.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings. It is to be noted, however, that the appended drawings illustrate only typical embodiments of this invention and are not to be considered limiting of its scope, for the invention may admit to other equally effective embodiments.

In FIG. 7A, the first finger member 41 and the second finger member 42 are arranged to retain the ball 5. In FIG. 7B, the first finger member 41 and the second finger member 42 are rotated to release the ball 5 into the wellbore. In FIG. 7C, the first finger member 41 and the second finger member 42 are rotated back when the dart is released downhole.

DETAILED DESCRIPTION OF THE PREFERRED EMBODIMENT

Figure 1:
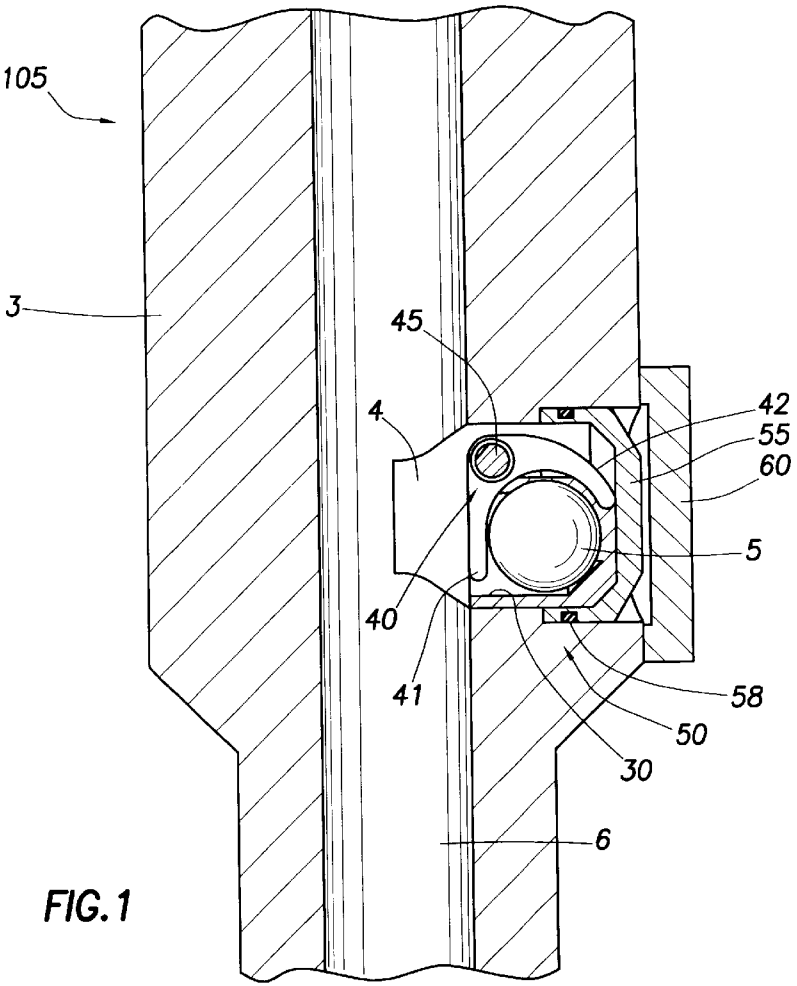
FIG. 1 is a sectional view of a ball dropping assembly of the present invention in a ball-retained position. The ball dropping assembly is shown disposed in a side bore of a cementing head.

FIG. 1 is a partial sectional view of a cementing head 105 showing one embodiment of the ball dropping assembly 50 of the present invention. The ball dropping assembly 50 is shown in a ball-retained position, with a ball 5 disposed therein. The ball dropping assembly 50 is disposed in a side bore 4 that is adjacent to a main bore 6 of the cementing head 105.

The ball dropping assembly 50 first comprises a seat 30 for holding the ball 5. The seat 30 defines a base on which the ball 5 sits while the assembly 50 is in the ball-retained position. The ball dropping assembly 50 also comprises a retaining lever 40. The retaining lever 40 retains the ball 5 within the seat 30 until the ball 5 is ready for release into the main bore 6. In the ball-retained position shown in FIG. 1, the retaining lever 40 acts to prevent the ball 5 from exiting the seat 30.

The retaining lever 40 is disposed within the side bore 4. The retaining lever 40 has a first finger member 41 and a second finger member 42 that meet to define an L-shape. Each finger 41, 42 may define a single elongated member as shown in FIG. 1. However, the term finger also defines any other protrusion for retaining and urging a ball 5. Examples include, but are not limited to a plate, or a fork having tines (not shown).

The retaining lever 40 is positioned in FIG. 1 such that the first finger 41 is disposed between the main bore 6 and the ball 5 so as to retain the ball within the seat 30. The first finger 41 preferably has a flat outer surface that is flush with the main bore 6 so that it does not interfere with any fluid or object that may be traveling down the main bore 6. In the ball-retained position, the ball 5 is initially maintained between the fingers 41, 42. In this regard, finger 42 is oriented inside of the side bore 4. The outer surface of the second finger 42 can be flat or straight. Preferably, the second finger 42 is curved where a spherical ball 5 is used as the dropped object. It should be appreciated that the two fingers 41, 42 do not have to form a perfect "L"; the angle formed by the two fingers 41, 42 may be less than or greater than 90 degrees. In addition, objects other than a spherical ball may be employed as the dropped object.

Figure 2:
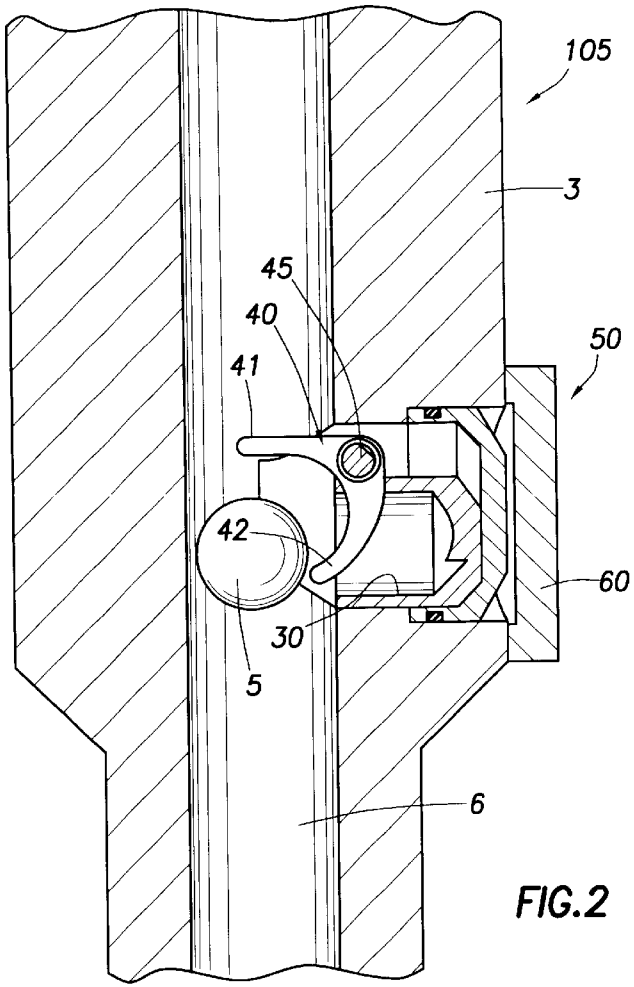
FIG. 2 is a sectional view of a ball dropping assembly of the present invention, but in a ball released position.

A shaft 45 is connected to the retaining lever 40 for rotating the retaining lever 40 between a retained position (FIG. 1) and a released position (FIG. 2). A cap 55 optionally is disposed at an outer end of the side bore 4 to prevent fluid leakage. The cap 55 has one or more seals 58 disposed around a diameter of the cap 55 to facilitate fluid retention. A retaining sleeve 60 is disposed at the exterior of the cementing head 105 to enclose the ball dropping assembly 50. The use of the cap 55 and retaining sleeve 60 permits the reloading of the ball dropping assembly 55 after a first ball 5 has been dropped. However, it is understood that the ball dropping assembly 50 may be reloaded from the bottom such that a removable cap 55 and retaining sleeve 60 are not needed. In this way, no disassembly of the ball dropping assembly is needed.

FIG. 2 depicts the ball dropping assembly of the present invention in its ball-released state. In this view, the retaining lever 40 is rotated such that the first finger 41 enters the main bore 6 and is in the path of any object moving from the cementing head 105 into the wellbore. Preferably, the retaining lever 40 is rotated 90 degrees so that the first finger 41 is perpendicular to the main bore 6. As shown, a portion of the second finger 42 is disposed in the main bore 6 to insure that the ball is fully released into the main bore 6. However, it is not necessary that any portion of the second finger 42 enter the main bore 6 once the retaining lever 40 is rotated to the released position, so long as the ball 5 is released.

The retaining lever 40 pivots about shaft 45. Rotation of the shaft 45 rotates the retaining lever 40 between the ball-retained position and the ball-released position. It is preferred that the shaft 45 extend through the body 3 of the cementing head 105 on both sides of the main bore 6. One advantage of having the shaft 45 extend through the body 3 on both sides is that the shaft 45 will be pressure balanced and will not require significant torque to rotate. In addition, and as will be shown, extending the shaft through both sides of the cementing head 105 provides visual confirmation of ball release from either side of the cementing head 105.

Figure 3:
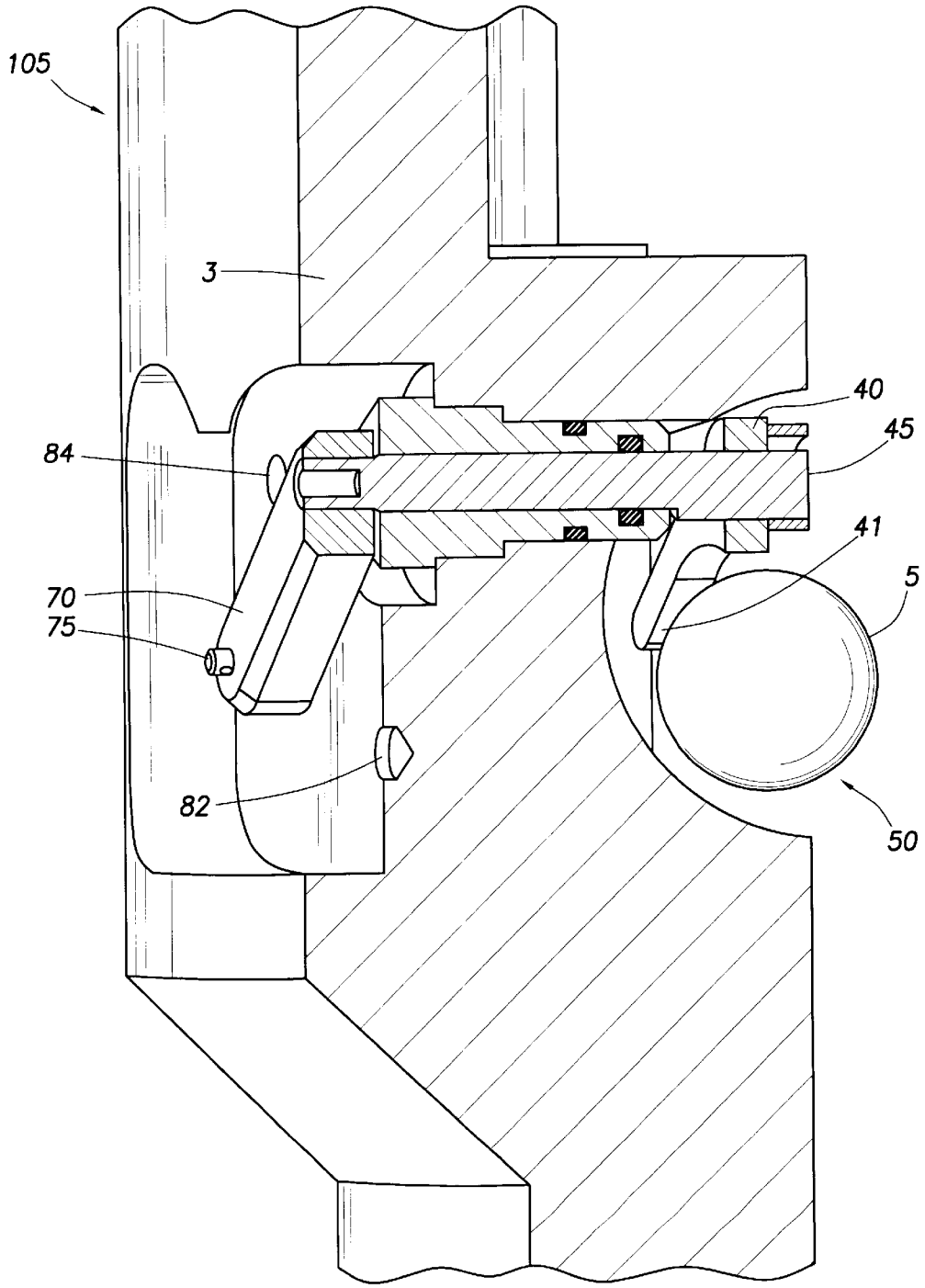
FIG. 3 is a cut-away view of a cementing head showing an aspect of an actuating lever according to the present invention.

FIG. 3 presents the ball releasing assembly 50 in a cross-sectional view. As illustrated in FIG. 3, an actuation lever 70 is connected to at least one end of shaft 45 for turning the shaft 45. Preferably, the actuation lever 70 is disposed on the outer surface of the cementing head 105 so that it may also function as a plug release indicator. A pin 75 is partially disposed in an end of the actuation lever 70 opposite the shaft 45 connection. The outer surface of the cementing head 105 has two detentes 82, 84 for mating with the pin 75. The pin 75 has a biasing mechanism (not shown) that forces the pin 75 into the outer surface of the cementing head 105. When the pin 75 is positioned over one of the detentes 82, 84, the biasing mechanism forces the pin 75 to mate with the détente 82, 84. Once the pin 75 mates with the détente 82, 84, the actuation lever 70 and the retaining lever 40 is held in position until additional force is supplied to force the pin 75 out of the détente 82 or 84.

In operation, the ball dropping assembly 50 is initially in the ball-retained position, with a ball 5 disposed therein. The retaining lever 40 is held in position by the pin 75 mating with a first détente 82. The first finger 41 is disposed entirely within the side bore 4, thereby allowing fluids or objects to travel down the main bore 6 unimpeded by the ball dropping assembly 50. The second finger 42 (visible in FIG. 2) is disposed adjacent the ball 5 and within the side bore 4.

When the ball 5 is ready for release, the actuation lever 70 is rotated. The pin 75 is forced out of the first détente 82, allowing the actuation lever 70 to be rotated such that the pin 75 engages the second détente 84. Rotating the actuation lever 70 causes the retaining lever 40 to move from its ball-retained position to its ball-released position. As the actuating lever 70 is rotated, the first finger 41 enters the main bore 6 until it reaches a position essentially perpendicular to the main bore 6. The second finger 42 simultaneously rotates toward the main bore 6 approximately 90 degrees and urges the ball 5 into the main bore 6 for release into the wellbore (not shown). When the pin 75 on the actuation lever 70 is above the second détente 84, the pin 75 mates with the second détente 84 to hold the actuation lever 70 and the retaining lever 40 in the ball-released position.

In the ball-released position, the retaining lever 40 may function as the plug-release indicator. The process by which plug-release is indicated is shown by FIGS. 4 and 5.

As noted, FIG. 2 presents a cross-sectional view of a portion of a cementing head 105. Visible in the cementing head 105 is one embodiment of a ball releasing assembly 50 of the present invention. The ball releasing assembly 50 is in its ball-released position. The ball 5 is being released into the main bore 6, whereupon it will fall into the wellbore (not shown).

Figure 4:
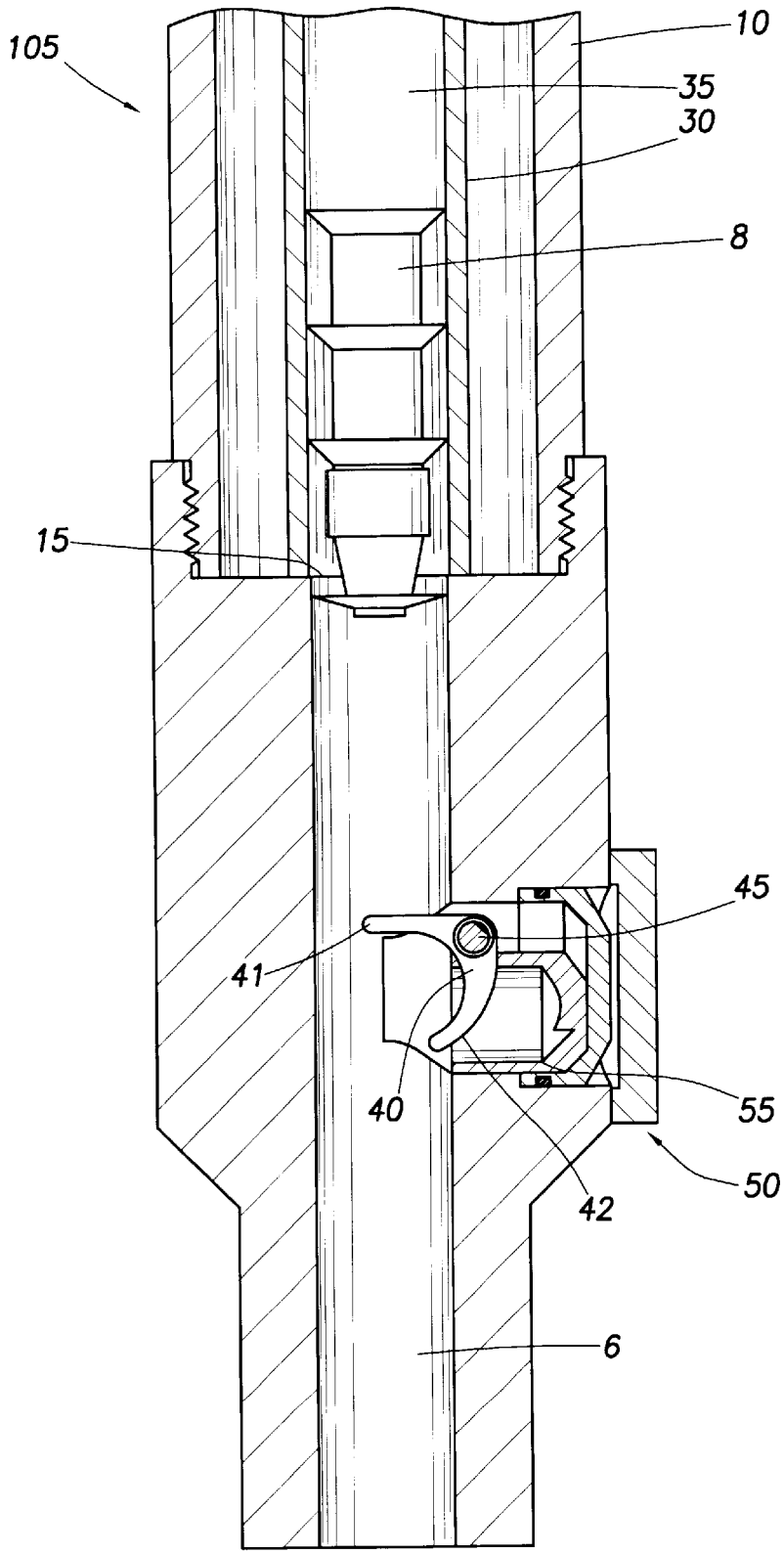
FIG. 4 is a cross-sectional view of a portion of a cementing head. Visible in the cementing head is one embodiment of a ball releasing assembly of the present invention, in its ball-released position. Also visible is a plug being released from the cementing head above the ball dropping assembly.
Figure 5:
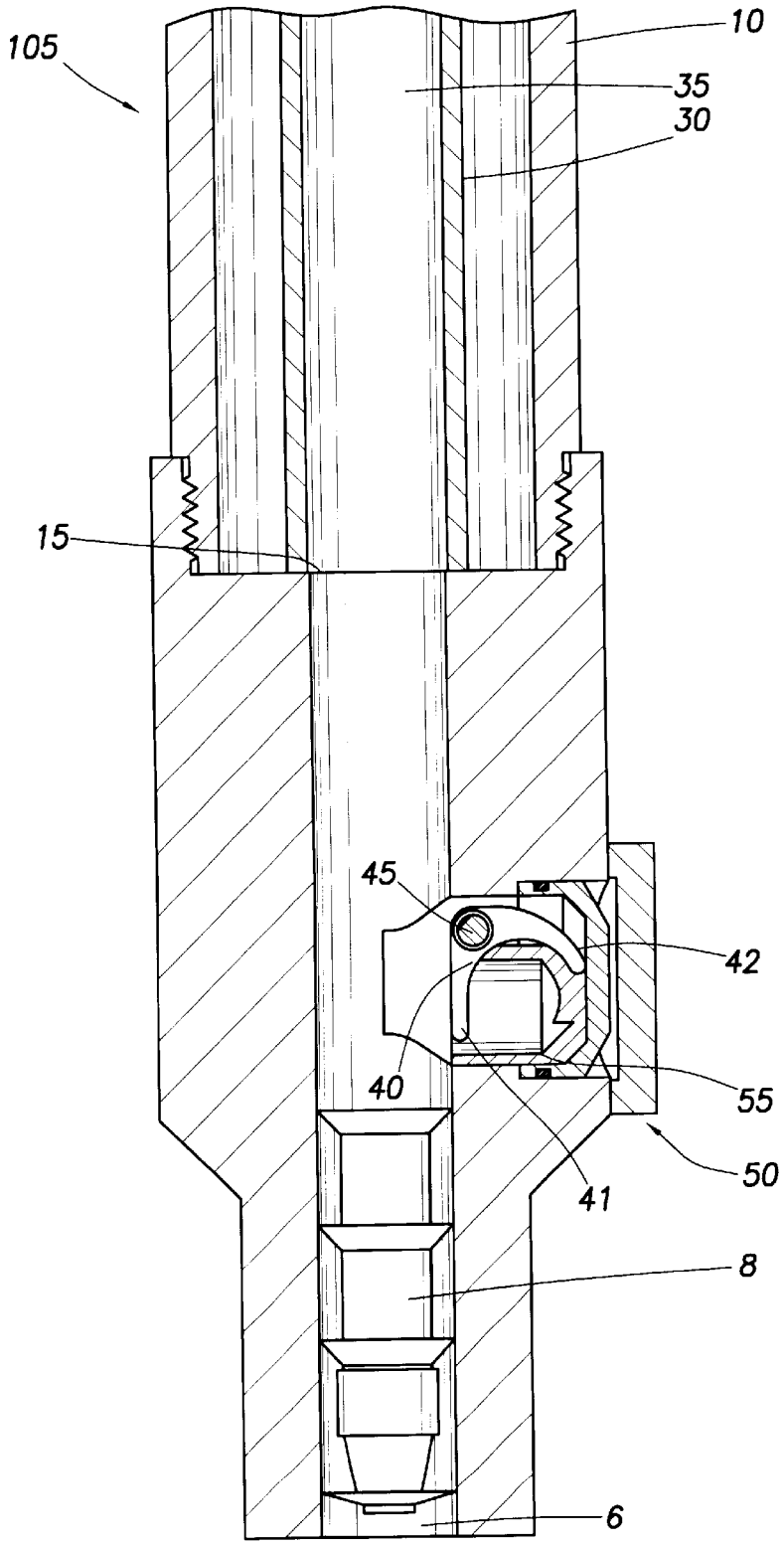
FIG. 5 is a cross-sectional view of the cementing head of FIG. 4. In this view, the plug has traveled through the main bore of the cementing head, and into the wellbore. The plug has also forced the lever of the ball-releasing assembly to return to its ball-retained position.

FIG. 4 presents a cross-sectional view of the cementing head portion 105 of FIG. 2. The ball releasing assembly 50 remains in its ball-released position. In this respect, the ball 5 has already been released into the main bore 6 and into the wellbore below. Thus, the ball is no longer visible within the cementing head 105 in the drawing of FIG. 4. Finger 41 of lever 40 is essentially perpendicular to the main bore 6 of the plug container 105. At this stage, drilling fluid may be introduced into the wellbore (not shown in FIG. 4) to clear debris from the annular space. The second détente 84 supplies sufficient resistance against fluid forces to maintain the first finger 41 in the main bore 6.

After the ball 5 is released, a dart 8 is released from the cementing head 105. The dart 8 is visible in FIG. 4. In order to release dart 8, a plug-dropping container is employed within the cementing head 105. The plug-dropping container primarily defines a canister 30 for retaining a plug 8 until release into the wellbore is desired. The canister portion 30 of a plug-dropping container is partially shown in FIG. 4, with a dart 8 disposed therein. The canister 30 is a tubular shaped member disposed co-axially within a tubular housing 10. The canister 30 has a channel 35 as its bore. The channel 35 is aligned with the bore 6 of the cementing head 105. Preferably, the inner diameter of the canister channel 35 is configured to match the inner diameter of the bore 6.

In operation, the dart 8 is disposed in the canister channel 35 when the cementing head 105 is in a plug-retained position. When released, the dart 8 travels downward out of the canister 30 and through a bottom opening 15. The bottom opening 15 is in fluid communication with main bore 6.

The typical plug-dropping apparatus includes some means for retaining the dart 8 until plug-release is desired. The typical plug-dropping apparatus also includes some means for diverting fluid around the dart 8 pending plug-release. These features are not shown in FIG. 4. However, it is understood that the ball-dropping assembly 50 of the present invention will work with any plug-dropping apparatus of any type, so long as the ball-dropping assembly 50 is positioned below the plug-dropping container. Therefore, details concerning any particular plug-dropping container are not needed.

After the dart 8 is released from a position above the ball dropping assembly 50, the dart 8 travels down the main bore 6 and contacts the first finger 41. FIG. 5 demonstrates the dart 8 further travelling downward into the wellbore. The force from the downward travelling dart 8 releases the pin 75 from the second détente 84 and rotates the retaining lever 40 back toward the ball-retained position. When the pin 75 is moved from the second détente 84, it indicates that the dart 8 was released. Thus, visual confirmation of dart-release is provided to the operator at the surface. Cement or other circulating fluid may subsequently be pumped into the wellbore behind the dart 8.

It may be desirable to release a second dart into the wellbore. Before releasing a new dart, the retaining lever 40 is rotated from its ball-retained position back to its ball-released position. As noted, the retaining lever 40 rotates about pivoting shaft 45 so that it is in position to indicate whether the second dart has been released. In the ball-released position, the first finger 41 of the retaining lever 40 is again disposed in the main bore 6, and the pin 75 is disposed in the second détente 84. Once the second dart is released and contacts the first finger 41, the retaining lever 40 rotates back toward the ball-retained position. The rotation also moves the pin 75 from the second détente 84 toward the first détente 82, thereby indicating that second dart has been released.

The dart 8 in FIGS. 4 and 5 is presented as a drill pipe dart. However, it is understood that the ball-dropping assembly 50 of the present invention has utility with any type of plug, such as a cement wiper plug (not shown).

Figure 6:
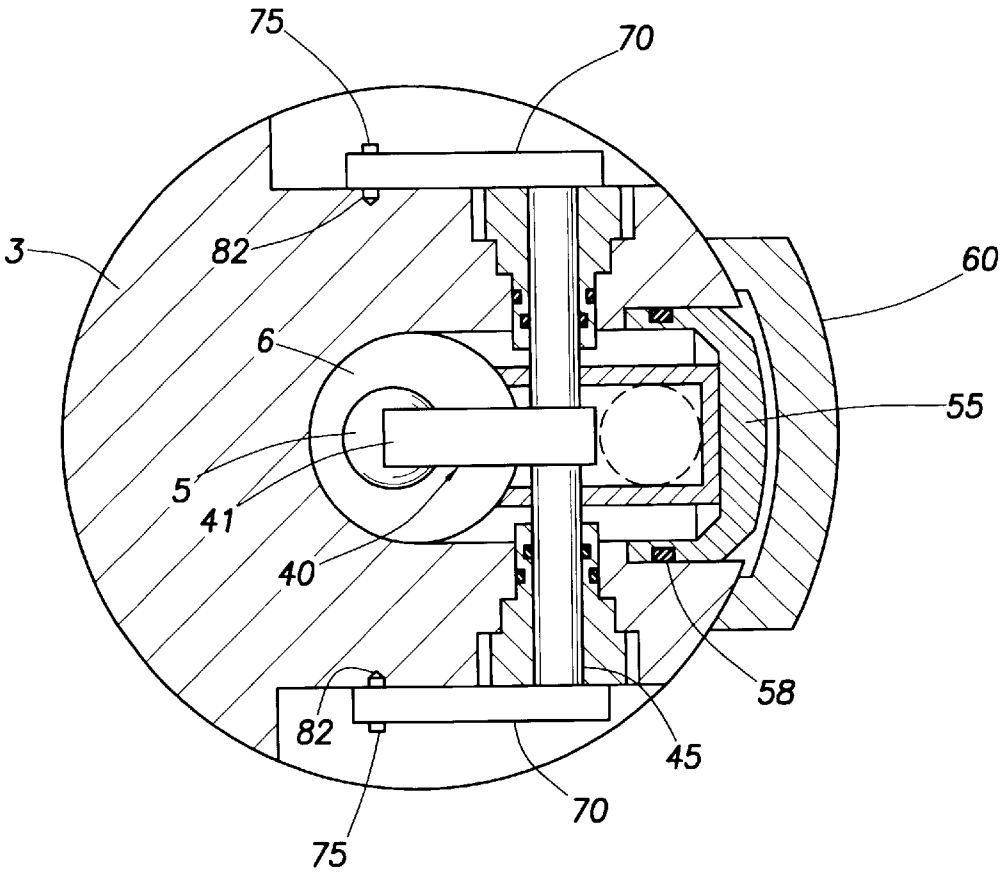
FIG. 6 is a top, cross-sectional view of a ball dropping assembly of the present invention, releasing a ball. Visible is the retaining lever rotating into the main bore of the cementing head.

FIG. 6 depicts the ball releasing assembly 50 of the present invention from a top, cross-sectional view. Present in this view is the elongated shaft 45. The shaft 45 extends perpendicular to the retaining lever 40. Preferably, and as shown in the embodiment of FIG. 6, the shaft extends from the lever 40 on both sides of the main bore 6. Extending the shaft 45 sealingly through the main bore 6 on both sides provides a pressure-balanced ball-dropping assembly that can be actuated with a small amount of torque.

Figure 7C:
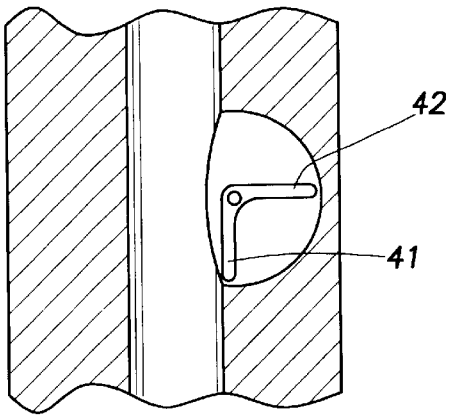
FIGS. 7A–7C present an alternate arrangement for indicating ball retention and dart release in a cementing head.
Figure 7B:
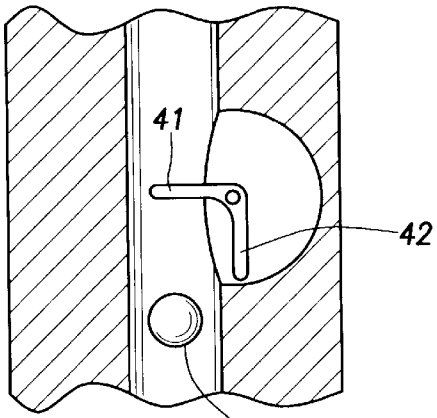
Figure 7A:
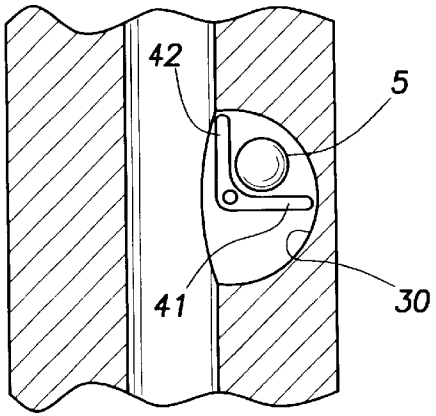

In the preferred embodiment, each end of the shaft 45 has an actuating lever 70 for rotating the shaft 45. The actuating levers 70 are located outside the cementing head 105 and are held in position by the detents 82, 84 (shown in FIG. 3) in the outer wall of the cementing head 150. It is understood that other arrangements for a combined ball-dropping and dart-release-indicating assembly are within the scope of the present invention. For example, the ball-retained position of the lever 70 may be different from the dart-released position of the lever 70. Such an arrangement is shown in FIGS. 7A–7C. In FIG. 7A, a first finger member 41 and a second finger member 42 are arranged to retain the ball 5 directly. In such an arrangement, the first finger member 41 serves as the seat 30 as well. In FIG. 7B, the first finger member 41 and the second finger member 42 are rotated to release the ball 5 into the wellbore. Then, as shown in FIG. 7C, the first finger member 41 and the second finger member 42 are rotated back when the dart (not shown) is released downhole.

Therefore, the present invention provides a ball dropping assembly that can effectively and efficiently combine the ball dropping function with the plug-release indicating function into a single apparatus. It is understood, though, that the ball-dropping assembly may be used without the plug-release indicating function. Further, the ball-dropping assembly may be utilized though either manual, power or remote activation.

It is noted that the plug container apparatus shown in FIGS. 4–5 is merely an example, and that the present invention is useful in connection with other procedures and equipment requiring a ball-releasing function. It is also within the scope of the present invention to use the ball-dropping assembly disclosed herein for dropping items other than balls.

While the foregoing is directed to embodiments of the present invention, other and further embodiments of the invention may be devised without departing from the basic scope thereof, and the scope thereof is determined by the claims that follow.

What is claimed is:

1. An assembly for dropping an object from the surface into a wellbore, comprising:

a seat for receiving the object at the surface;

a retaining lever for temporarily retaining the object in the seat at the surface; and a shaft through the lever about which the lever pivots between an object-retained position to an object-released position.

2. The assembly of claim 1, wherein:

the retaining lever has a first finger member and a second finger member; and the object is retained between the first and second finger members when the lever is rotated to its object-retained position.

3. The assembly of claim 2, wherein the first finger member is at least partially disposed in the bore when the lever is in its object-released position.

4. The assembly of claim 3, wherein the lever is rotated from its object-released position towards its object-retained position when a plug is released into the wellbore and travels downward across the first finger member.

5. The assembly of claim 4, further comprising a cap to prevent fluid leakage from the wellbore.

6. The assembly of claim 3, wherein:

the object is a spherical ball; and the first finger member and the second finger member each define an elongated member which meet at an end to form an essentially 90 degree angle.

7. The assembly of claim 6, wherein the assembly is disposed in a side bore that is adjacent to a main bore of a cementing head.

8. The assembly of claim 7, wherein a ball may be loaded into the seat without disassembly of the assembly.

9. The assembly of claim 8, wherein a ball may be loaded into the seat from the bottom of the cementing head.

10. The assembly of claim 1, wherein the shaft extends through a body of a cementing head so as to provide a substantially pressure-balanced configuration.

11. The assembly of claim 10, further comprising at least one actuation lever disposed on an end of the shaft for rotating the shaft, and for providing visual confirmation that the shaft has rotated.

12. The assembly of claim 11, further comprising:

a pin at least partially disposed within the at least one actuation lever; and one or more détentes in the body for mating with the pin.

13. The assembly of claim 12, wherein:

the retaining lever has a first finger member and a second finger member;

the object is retained between the first and second finger members when the lever is rotated to its object-retained position; and the object is a spherical ball.

14. The assembly of claim 13, wherein the retaining lever is rotated about the shaft between the ball-retained position and the ball-released position.

15. The assembly of claim 14, wherein rotating the retaining lever between its object-retained position and its object-released position includes moving the one or more actuation levers between the first détente and the second détente.

16. The assembly of claim 15, wherein the assembly is disposed in a side bore that is adjacent to a main bore of a cementing head.

17. The assembly of claim 16, wherein a ball may be loaded into the seat without disassembly of the assembly.

18. The assembly of claim 17, wherein a ball may be loaded into the seat from the bottom of the cementing head.

19. The assembly of claim 15, wherein the retaining lever is rotated manually from the ball-retained position towards the ball-released position.

20. The assembly of claim 15, wherein rotation of the retaining lever is power driven.

21. The assembly of claim 15, wherein rotation of the retaining lever is accomplished remotely.

22. A cementing head, comprising:

a main bore for receiving a plug;

a side bore in fluid communication with the main bore;

a seat disposed in the side bore for releasably retaining a spherical ball;

a retaining lever; and a shaft through the retaining lever about which the retaining lever pivots between a ball-retained position and a ball-released position.

23. The cementing system of claim 22, wherein the retaining lever includes a first finger member and a second finger member;

the spherical ball is contained between the first finger member and the second finger member when the retaining lever is in its ball-retained position; and the first finger member protrudes into the main bore when the retaining lever is in its ball-released position.

24. The cementing system of claim 23, wherein the shaft extends through each side of a bore in the cementing head.

25. The cementing head of claim 24, wherein the retaining lever is rotated manually from the ball-retained position towards the ball-released position.

26. The cementing head of claim 24, wherein rotation of the retaining lever is power-driven.

27. The cementing head of claim 24, wherein rotation of the retaining lever is accomplished remotely.

28. The cementing head of claim 24, further comprising at least one actuation lever disposed on an end of the shaft for turning the retaining lever, and for providing visual confirmation that the shaft has been rotated.

29. The assembly of claim 24, wherein a ball may be loaded into the seat without disassembly of the assembly.

30. The assembly of claim 29, wherein a ball may be loaded into the seat from the bottom of the cementing head.

31. The cementing head of claim 28, further comprising:

a pin at least partially disposed within the at least one actuation lever; and one or more detentes disposed on an outer surface of the body for receiving the pin.

32. The cementing head of claim 31, wherein moving the pin from a first détente to a second détente rotates the retaining lever from its ball-retained position to its ball-released position.

33. The cementing head of claim 32, further comprising a cap to prevent fluids from leaking from the side bore.

34. The cementing head of claim 32, wherein the retaining lever is rotated from its ball-released position towards its ball-retained position when a plug is released from the cementing head downhole and travels past the first finger, such that rotation provides confirmation of plug-release.

35. The cementing head of claim 34, wherein the retaining lever is rotated manually from the ball-retained position towards the ball-released position.

36. The cementing head of claim 35, wherein rotation of the retaining lever is power-driven.

37. The cementing head of claim 34, wherein rotation of the retaining lever is accomplished remotely.

38. An assembly for dropping a ball into a wellbore, the assembly being disposed in a side bore that is adjacent to a main bore of a cementing head, the assembly comprising:

a seat for the ball; and a retaining/releasing mechanism for retaining the ball in the seat and for releasing the ball into the main bore;

wherein the ball is loaded into the seat from the main bore of the cementing head and without disassembly of the assembly.

39. The assembly of claim 38, wherein the retaining/releasing mechanism is a lever.

40. The assembly of claim 38, further comprising a shaft through the lever about which the lever pivots between a ball-retained position to a ball-released position.

41. The assembly of claim 40, wherein:

the retaining lever has a first finger member and a second finger member; and the ball is retained between the first and second finger members when the lever is rotated to its ball-retained position.

42. The assembly of claim 41, wherein the first finger member is at least partially disposed in the bore when the lever is in its ball-released position.

43. The assembly of claim 42, wherein the lever is rotated from its object-released position towards its object-retained position when a plug is released into the wellbore and travels downward across the first finger member.

44. The assembly of claim 43, wherein the first finger member and the second finger member each define an elongated member which meet at an end to form an essentially 90 degree angle.

45. The assembly of claim 44, wherein the shaft extends through a body of a cementing head so as to provide a substantially pressure-balanced configuration.

46. The assembly of claim 45, wherein one of the first and second finger members also serves as the seat.

* * * * *